US009129503B2

(12) United States Patent
Borlenghi

(10) Patent No.: US 9,129,503 B2
(45) Date of Patent: Sep. 8, 2015

(54) LOCKING GPS DEVICE FOR LOCATING CHILDREN

(71) Applicant: Malcolm Larry Borlenghi, Westfield, NJ (US)

(72) Inventor: Malcolm Larry Borlenghi, Westfield, NJ (US)

( * ) Notice: Subject to any disclaimer, the term of this patent is extended or adjusted under 35 U.S.C. 154(b) by 0 days.

(21) Appl. No.: 14/456,469

(22) Filed: Aug. 11, 2014

(65) Prior Publication Data

US 2014/0361892 A1 Dec. 11, 2014

Related U.S. Application Data

(63) Continuation-in-part of application No. 13/694,211, filed on Nov. 7, 2012, now abandoned.

(51) Int. Cl.

| | |
|---|---|
| ***G08B 21/00*** | (2006.01) |
| ***G08B 21/02*** | (2006.01) |
| ***A45F 5/00*** | (2006.01) |

(52) U.S. Cl.

CPC ..... *G08B 21/0269* (2013.01); *A45F 5/00* (2013.01); *A45F 2005/008* (2013.01); *A45F 2200/0525* (2013.01); *G08B 21/0202* (2013.01); *G08B 21/0283* (2013.01); *G08B 21/0286* (2013.01); *G08B 21/0288* (2013.01)

(58) Field of Classification Search

CPC ..... G08B 21/0202; G08B 21/0288; G08B 21/0286; G08B 21/0283; A45F 2005/008

USPC ..... 224/219, 221, 222, 267, 930; 340/539.13, 539.15, 573.4, 539.31, 340/572.9; 70/49, 16, 14, 18, 19, 30, 58, 70/223, 280, 345, 352

See application file for complete search history.

(56) References Cited

U.S. PATENT DOCUMENTS

| | | | | | |
|---|---|---|---|---|---|
| 4,452,059 | A | * | 6/1984 | Sornes | 70/278.2 |
| 4,754,630 | A | * | 7/1988 | Kawakami | 70/352 |
| 4,812,823 | A | * | 3/1989 | Dickerson | 340/573.4 |
| 4,860,562 | A | * | 8/1989 | Koren et al. | 70/352 |
| 5,025,647 | A | * | 6/1991 | Muus | 70/352 |
| 5,146,770 | A | * | 9/1992 | Yun-Sheng | 70/38 C |
| 5,291,761 | A | * | 3/1994 | Lii | 70/18 |
| 5,298,884 | A | * | 3/1994 | Gilmore et al. | 340/573.4 |
| 5,343,724 | A | * | 9/1994 | Sornes | 70/340 |
| 5,357,254 | A | * | 10/1994 | Kah, Jr. | 342/42 |
| 5,367,785 | A | * | 11/1994 | Benarroch | 33/767 |
| 5,471,199 | A | * | 11/1995 | Yuan | 340/574 |
| 5,497,149 | A | * | 3/1996 | Fast | 340/988 |
| 5,543,780 | A | * | 8/1996 | McAuley et al. | 340/572.1 |
| 5,604,331 | A | * | 2/1997 | Matarin et al. | 174/121 A |
| 5,612,675 | A | * | 3/1997 | Jennings et al. | 340/573.1 |

(Continued)

FOREIGN PATENT DOCUMENTS

WO WO2009053667 A1 4/2009

*Primary Examiner* — Justin Larson
(74) *Attorney, Agent, or Firm* — Thomas J. Germinario

(57) ABSTRACT

A GPS-based child-locator device can be securely locked to a child's wrist or ankle so as to be removable only by using one or more custom mechanical keys and/or resettable software keys/codes. This prevents the child-locator device from being disabled by being removed from the child during an abduction. The GPS locator comprises a housing unit, a connecting band, by which the housing unit is attachable to a child, and a locking mechanism, by which the connecting band is lockably attachable to the housing unit. The GPS locator also utilizes a novel antenna design to achieve a very compact profile for the housing which contains the device's electrical components.

6 Claims, 10 Drawing Sheets

(56) References Cited

U.S. PATENT DOCUMENTS 5,617,074 A * 4/1997 White ..... 340/573.4
5,627,520 A * 5/1997 Grubbs et al. ..... 340/572.1
5,836,002 A * 11/1998 Morstein et al. ..... 340/568.1
5,900,817 A * 5/1999 Olmassakian ..... 340/573.1
5,912,623 A * 6/1999 Pierson ..... 340/573.4
5,936,529 A * 8/1999 Reisman et al. ..... 340/573.1
5,936,530 A * 8/1999 Meinhold ..... 340/573.1
6,127,931 A * 10/2000 Mohr ..... 340/573.4
6,239,715 B1 * 5/2001 Belton ..... 340/691.3
6,243,039 B1 * 6/2001 Elliot ..... 342/457
6,271,751 B1 * 8/2001 Hunt et al. ..... 340/514
6,278,370 B1 * 8/2001 Underwood ..... 340/573.1
6,374,648 B1 * 4/2002 Mitsuyama ..... 70/57.1
6,472,989 B2 * 10/2002 Roy, Jr. ..... 340/573.4
6,593,851 B1 * 7/2003 Bornstein ..... 340/539.15
6,958,698 B2 * 10/2005 Maloney ..... 340/572.8
6,989,752 B2 * 1/2006 Shugrue ..... 340/573.1
6,992,582 B2 * 1/2006 Hill et al. ..... 340/539.13
7,084,764 B2 * 8/2006 McHugh et al. ..... 340/568.2
7,106,197 B2 * 9/2006 Gaiotto et al. ..... 340/572.1
7,135,943 B2 * 11/2006 Lin et al. ..... 333/132
D535,205 S * 1/2007 Frederick et al. ..... D10/104.1
7,210,317 B2 * 5/2007 Beane et al. ..... 70/16
7,233,245 B2 * 6/2007 O'Neill ..... 340/568.2
7,271,717 B1 * 9/2007 Amos ..... 340/539.15
7,334,711 B1 * 2/2008 Winters ..... 224/217
D571,249 S * 6/2008 Frederick et al. ..... D11/4
7,394,376 B1 * 7/2008 Sayegh et al. ..... 340/572.1
D578,918 S * 10/2008 Aninye ..... D10/104.1
7,456,355 B2 * 11/2008 Blakeway ..... 174/50
7,511,627 B2 * 3/2009 Holoyda ..... 340/573.4
7,636,047 B1 * 12/2009 Sempek ..... 340/572.8
7,810,683 B2 * 10/2010 Chan ..... 224/222
7,823,425 B2 * 11/2010 Crossley ..... 70/80
7,864,059 B2 * 1/2011 Lee ..... 340/573.4
7,956,753 B2 * 6/2011 Fogg ..... 340/573.1
8,115,621 B2 * 2/2012 Rajala et al. ..... 340/539.13
8,149,110 B2 * 4/2012 Troxler ..... 340/539.11
8,294,583 B2 * 10/2012 Sayegh et al. ..... 340/572.9
8,416,082 B2 * 4/2013 Sayegh et al. ..... 340/572.8
8,505,342 B1 * 8/2013 Taiga ..... 70/14
8,514,070 B2 * 8/2013 Roper et al. ..... 340/539.13
8,525,670 B1 * 9/2013 Khaira ..... 340/539.13
D693,251 S * 11/2013 Anderssen et al. ..... D10/70
8,624,723 B2 * 1/2014 Troxler ..... 340/539.11
8,698,623 B1 * 4/2014 Hicks ..... 340/539.15
8,747,336 B2 * 6/2014 Tran ..... 600/587
8,752,407 B2 * 6/2014 Taiga ..... 70/30
8,831,627 B2 * 9/2014 Aninye et al. ..... 455/456.1
8,854,207 B2 * 10/2014 Williams ..... 340/539.13
9,013,301 B2 * 4/2015 Williams ..... 340/539.13
9,013,351 B2 * 4/2015 Park et al. ..... 342/357.31
2003/0174059 A1 * 9/2003 Reeves ..... 340/573.4
2004/0198382 A1 * 10/2004 Wong ..... 455/456.1
2005/0020274 A1 * 1/2005 Ursini ..... 455/456.1
2005/0225449 A1 * 10/2005 Blakeway ..... 340/573.4
2006/0006960 A1 * 1/2006 Lin et al. ..... 333/132
2006/0242423 A1 * 10/2006 Kussmaul ..... 713/182
2007/0125816 A1 * 6/2007 Myers ..... 224/221
2008/0047990 A1 * 2/2008 Morgan et al. ..... 224/222
2008/0218358 A1 * 9/2008 Derrick et al. ..... 340/573.1
2008/0278309 A1 * 11/2008 Troxler ..... 340/539.1
2008/0284601 A1 * 11/2008 Sayegh et al. ..... 340/572.1
2009/0042534 A1 * 2/2009 Levanen ..... 455/404.2
2009/0285135 A1 * 11/2009 Rousu et al. ..... 370/297
2009/0289844 A1 * 11/2009 Palsgrove et al. ..... 342/357.07
2010/0097282 A1 * 4/2010 Chirila ..... 343/770
2010/0287998 A1 * 11/2010 Anderson et al. ..... 70/57.1
2011/0068140 A1 * 3/2011 Stevens et al. ..... 224/533
2011/0109461 A1 * 5/2011 Aninye ..... 340/573.4
2011/0140894 A1 * 6/2011 Sayegh et al. ..... 340/572.8
2012/0122519 A1 * 5/2012 Jochheim ..... 455/556.1
2012/0168471 A1 * 7/2012 Wilson ..... 224/152
2012/0230377 A1 * 9/2012 Jenwatanavet et al. ..... 375/222
2012/0235860 A1 * 9/2012 Ghazarian ..... 342/357.4
2013/0016016 A1 * 1/2013 Lin et al. ..... 343/702
2013/0100000 A1 * 4/2013 Reavis et al. ..... 343/895
2014/0055309 A1 * 2/2014 Jenwatanavet ..... 343/718
2014/0124389 A1 * 5/2014 Borlenghi ..... 206/37
2014/0180365 A1 * 6/2014 Perryman et al. ..... 607/60
2014/0266935 A1 * 9/2014 Tankiewicz ..... 343/720
2014/0308930 A1 * 10/2014 Tran ..... 455/414.1
2014/0378853 A1 * 12/2014 McKinney et al. ..... 600/509
2015/0070226 A1 * 3/2015 Wong et al. ..... 343/718
2015/0091765 A1 * 4/2015 Frank et al. ..... 343/718

* cited by examiner

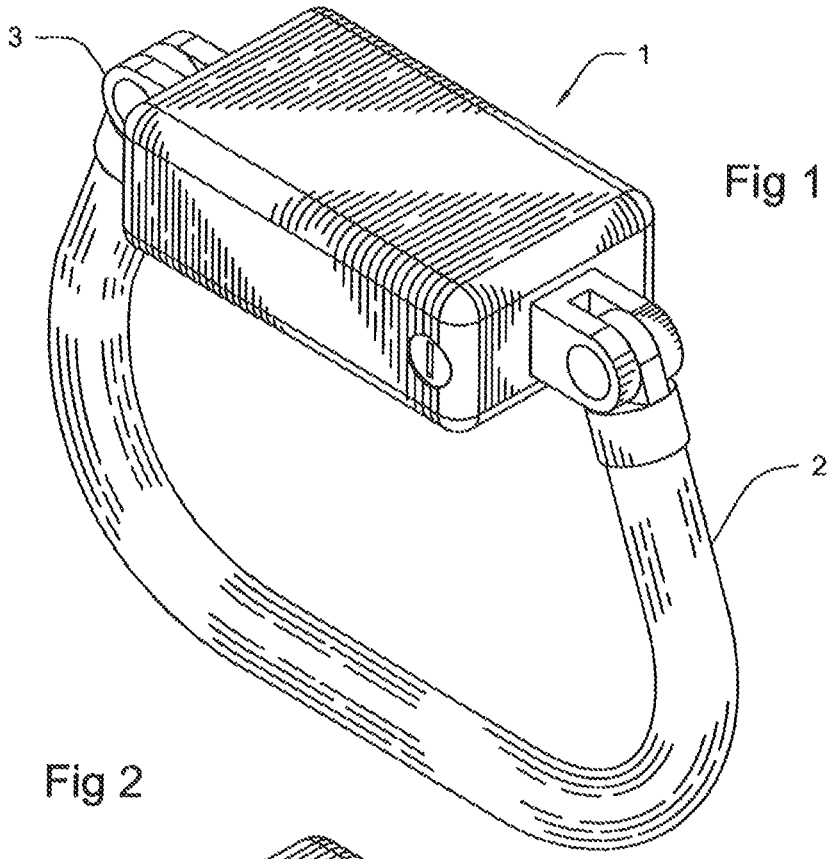
Fig 1
Fig 2
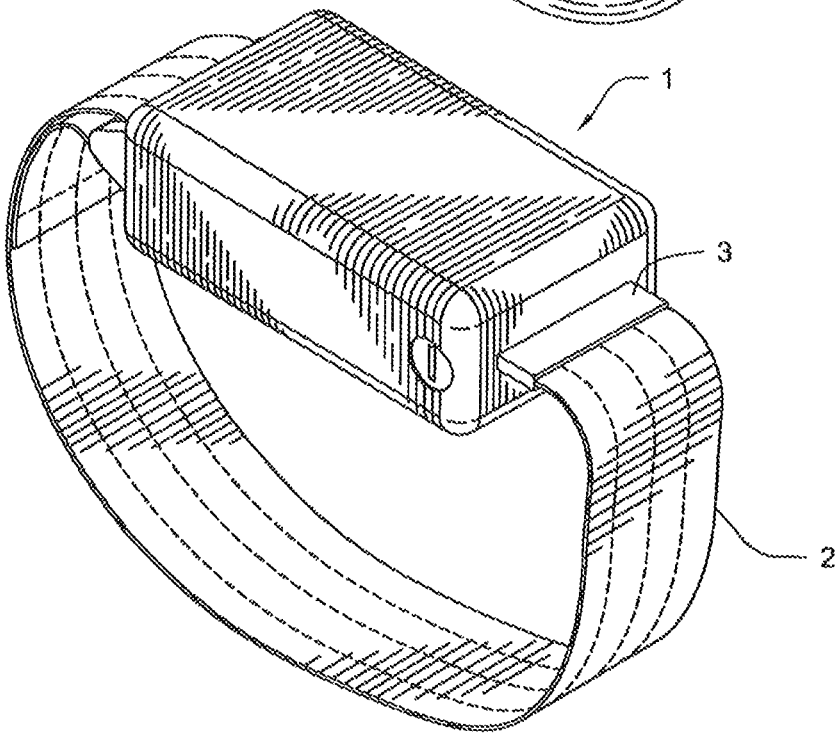

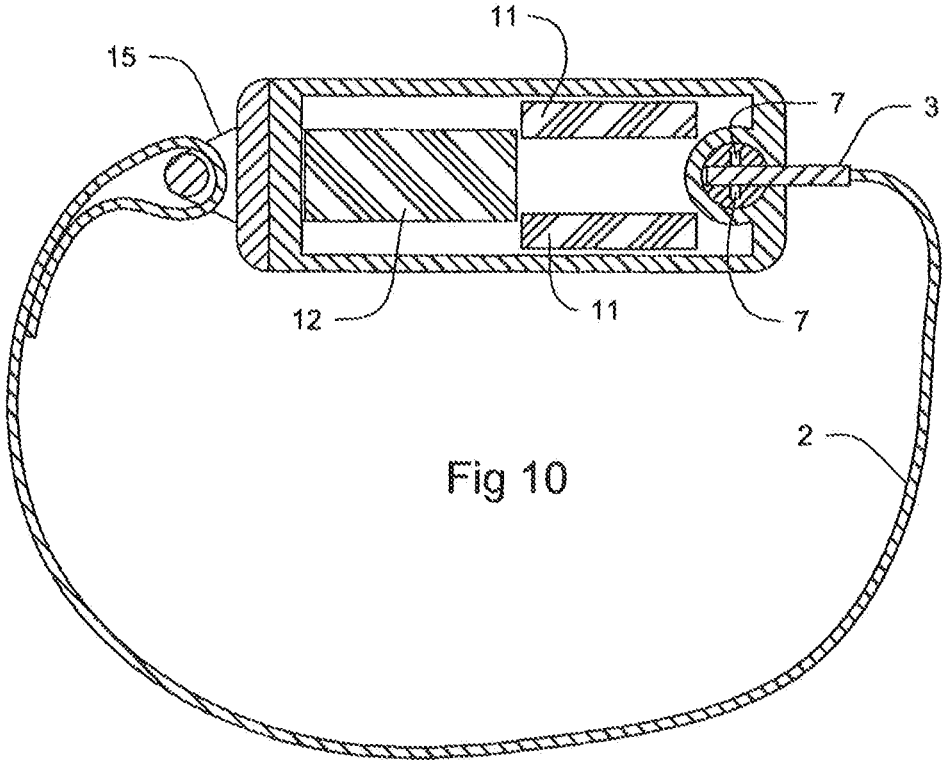
Fig 10
Fig 11
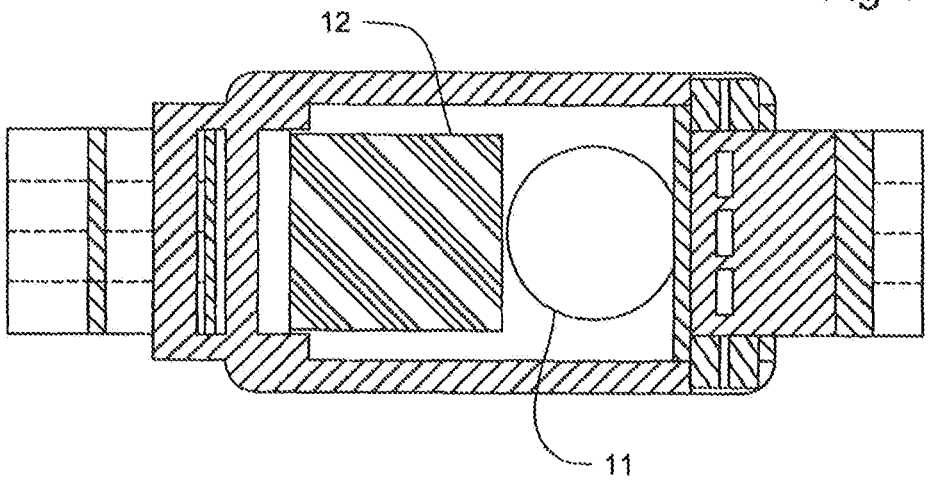

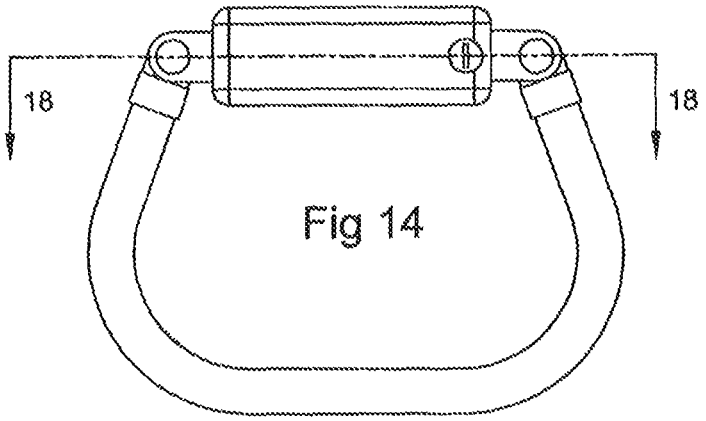
Fig 14
Fig 15
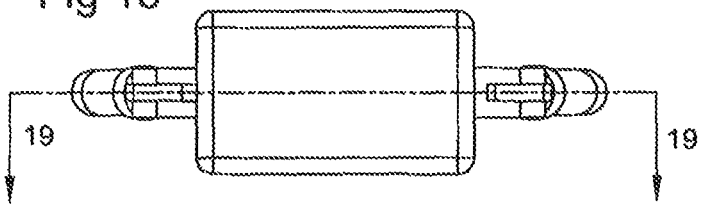
Fig 16
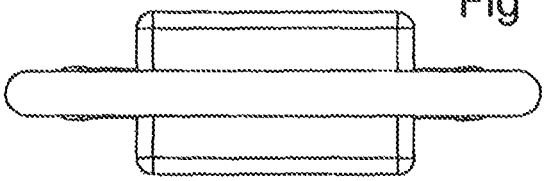
Fig 17
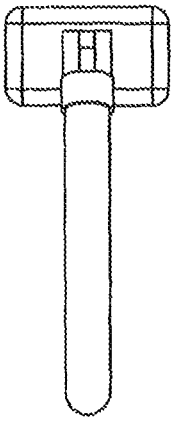
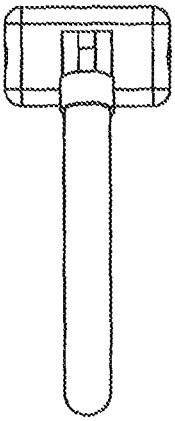
Fig 18

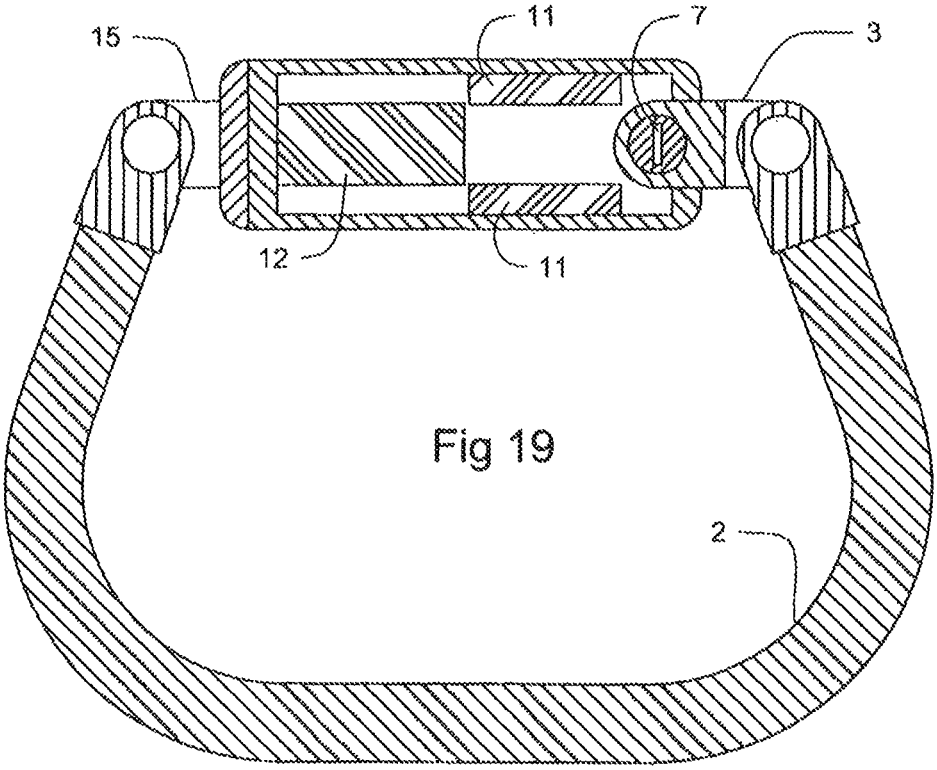
Fig 19
Fig 20
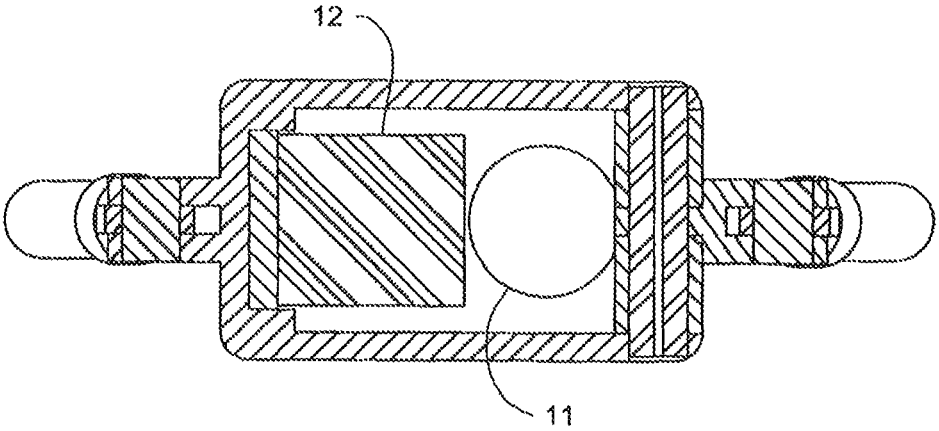

LOCKING GPS DEVICE FOR LOCATING CHILDREN

REFERENCE TO RELATED APPLICATION

This application is a Continuation-in-Part of application Ser. No. 13/694,211, which was filed on Nov. 7, 2012, now abandoned, and the disclosure of which is incorporated herein by reference.

FIELD OF INVENTION

The present invention relates to the general field of GPS devices and more particularly to GPS devices for locating children.

BACKGROUND OF THE INVENTION

The prior art in this field discloses several GPS-based locator devices, which are wearable by a child and/or concealable on his/her person. These devices generally comprise a GPS receiver and a transmitter component, such as a wireless telephone. Examples of such devices are described in the U.S. patent application publications of Wong (2004/0198382 A1) and Levanen (2009/0042534 A1), the disclosures of which are incorporated herein by reference.

A major disadvantage of the prior art GPS child-locator devices is that they can be readily defeated by removing the device from the child's person. Since the availability of such GPS locators has been widely publicized, a kidnapper or sexual predator is likely to search a child after an abduction for such a device and remove it, thereby rendering its tracking function inoperative.

Another critical problem of the prior art GPS child-locator designs is the need to accommodate wireless telephonic transmission/reception components within a housing that is compact enough to be worn on or attached to the child's body without obstructing his/her movements.

The present invention addresses the deficiencies in the prior art GPS-based child-locator devices by providing a device which can be securely locked to a child's wrist or ankle so as to be removable only by using one or more custom mechanical keys and/or resettable software keys/codes. The present invention also utilizes a novel antenna design to achieve a very compact profile for the housing which contains the device's electrical components.

SUMMARY OF THE INVENTION

The locking GPS-based locator device, wearable by a child, comprises a housing unit, a connecting band, by which the housing unit is attachable to the child, and a locking mechanism, by which the connecting band is lockably attachable to the housing unit. The housing unit has a proximal side and a distal side and defines a housing interior space, which contains a GPS module, a cellular module, one or more high band antennas in electrical communication with the cellular module and the GPS module, a processing circuit, and a power source. The connecting band has a distal end, which is fixedly attached to the distal side of the housing unit, and a proximal end, which is lockably attachable through the locking mechanism to the proximal side of the housing unit. The connecting band also contains one or more low-band antennas, which communicate electrically with the cellular module in the housing unit.

The GPS module, upon activation, is configured to receive satellite GPS location data for a current location of the locator device and to transmit the GPS location data to the processing circuit, which converts the GPS location date to one or more outgoing locator message signals, in text or audible format, that are sent by the cellular module through one of the high-band or low-band antennas to one or more designated contacts. The GPS module is activated in a response mode, through the processing circuit, by the cellular module in response to a location request, in text or audible format, received through one of the high-band or low-band antennas. The GPS is also activated in a periodic mode by the processing circuit at designated intervals.

In order to operate effectively on a wireless telephonic network, the cellular module of the locator device must be capable of transmitting and receiving at both a high-frequency and a low-frequency band. The two predominant bands used in U.S. wireless networks are the 850 MHz low-band, which transmits at 824-849 MHz and receives at 869-894 MHz, and the 1900 MHz high-band, which transmits at 1850-1910 MHz and receives at 1930-1990 MHz. More generally, low-band antennas operate in the range of 700-1000 MHz, while high-band antennas operate in the range of 1700-2200 MHz.

Since the optimal size of an antenna increases in relation to the wavelength of the signals it transmits/receives, an effective low-band antennas must be substantially larger than its high-band counterpart. Consequently, the footprint required for an effective low-band antenna would demand a housing unit too large to be comfortably worn by a child on the wrist or ankle For that reason, the design of the present invention locates the low-band antenna(s) in the connecting band, rather than in the housing unit.

In order to enable the low-band antennas to be located in the connecting band, the processing circuit includes a diplex filter, in electrical communication with the cellular module, which separates the outgoing locator message signals into high-pass frequencies and low-pass frequencies, with the high-pass frequencies going to the high-band antenna(s) in the housing unit, and the low-pass frequencies going to the low-band antenna(s) in the connecting band, as shown in FIG. 21.

While the locking mechanism can be a mechanical one, a conventional keyed tumbler lock will not fit within the constrained housing interior space. The locking mechanism can comprise a custom mechanical locking system, in which an array of locking springs on the proximal side of the housing unit conjugately engage a cooperating array of band apertures in the proximal end of the connecting band, as shown in FIG. 22. A flat key with a horizontal array of projections of different lengths, corresponding to positions of the locking springs, when inserted, without turning, into a key opening between the locking springs and the band apertures, lifts the locking springs, thereby releasing the proximal end of the connecting band from the proximal side of the housing unit.

Alternately, or in conjunction with the custom mechanical locking system, the locking mechanism can comprise an electromagnetic locking mechanism, having a de-energized locked configuration, in which a spring-loaded plunger pin extending through the proximal side of the housing unit conjugately engages a cooperating band aperture in the proximal end of the connecting band, as shown in FIG. 23B. In the energized unlocked configuration of the electromagnetic locking mechanism, the electromagnet generates on a magnetic field which draws the plunger pin away from the band aperture so that it disengages, thereby releasing the proximal end of the connecting band from the proximal side of the housing unit, as shown in FIG. 23A.

For maximum tamper-proof security, the housing unit is preferably made of a high-strength thermoplastic, such as polycarbonate. The connecting band can consist of a high-strength thermoplastic polymer reinforced with a titanium alloy. Both the housing unit and the connecting band are water proof and fire resistant.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

BRIEF DESCRIPTION OF THE DRAWINGS

FIG. 1 is a perspective view of the invention with a chain type band.

FIG. 2 is a perspective view of the invention with a flat band.

FIG. 10 is a side cross-section view of the invention of FIG. 6, along the line 11-11.

FIG. 11 is a top cross-section view of the invention of FIG. 5, along the line 10-10.

FIG. 14 is a side view of the chain type band invention.

FIG. 15 is a top view of the chain type band invention.

FIG. 16 is a bottom view of the chain type band invention.

FIG. 17 is a perspective view of the front of the chain type band invention.

FIG. 18 is a perspective view of the back of the chain type band invention.

FIG. 19 is a side cross-section view of invention of FIG. 15, along the line 19-19.

FIG. 20 is a top cross-section view of the invention of FIG. 14, along the line 18-18.

DETAILED DESCRIPTION OF THE PREFERRED EMBODIMENT

Figure 3:
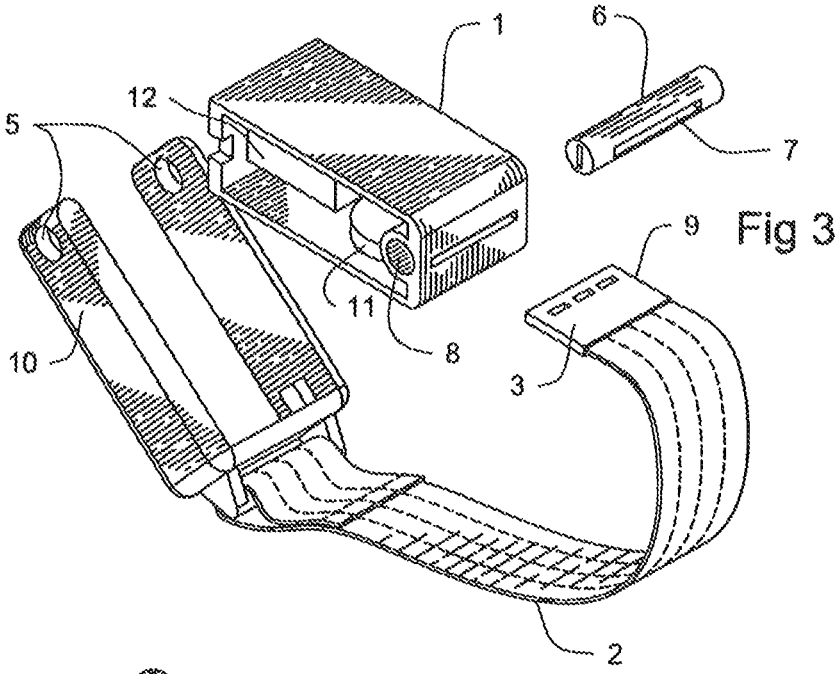
FIG. 3 is an exploded view of the bottom side of the locking mechanism of the flat band invention.
Figure 4:
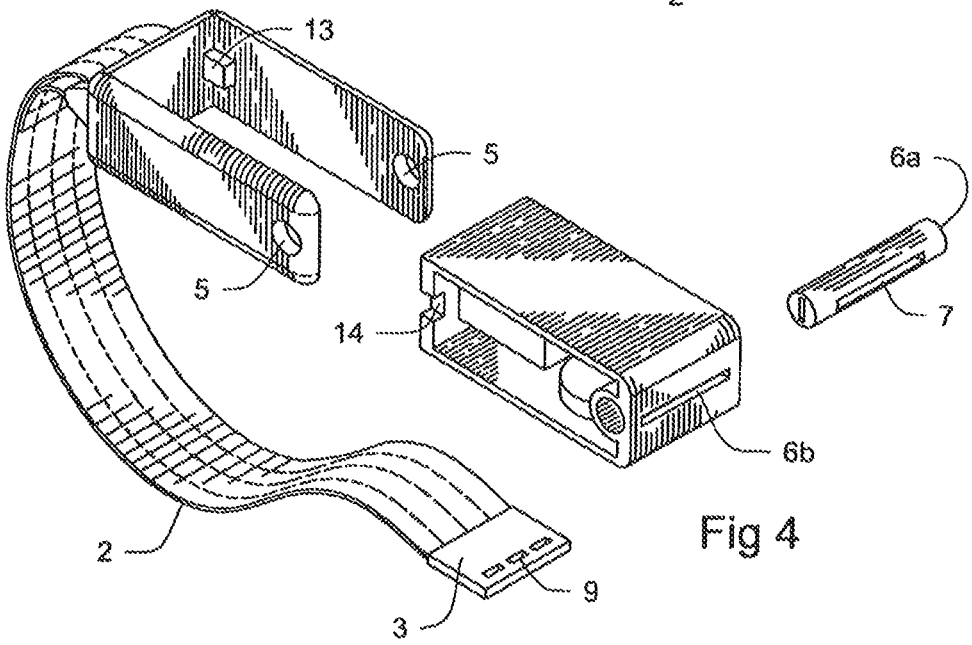
FIG. 4 is an exploded view of the top side of the locking mechanism of the flat band invention.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

An apparatus for housing a GPS device for locating children according to the present invention will now be described in detail with reference to FIGS. 1 through 24 of the accompanying drawings. More particularly, an apparatus housing a GPS device for locating children FIG. 1 according to the present invention includes a housing unit 1 and a flat band 2 (FIG. 2) or chain band 2 (FIG. 1).

The housing unit 1 (shown in FIGS. 3 and 4 for the flat band, and FIGS. 12 and 13 for the chain band) houses a small "thermoplastic" internal water and fire proof container 12, which holds the GPS module. The housing unit 1 also contains a storage unit 11 for two lithium batteries to power the GPS module.

The housing unit 1 (shown in FIGS. 3 and 4 for the flat band, and FIGS. 12 and 13 for the chain band) contains a locking mechanism 6*a* and 6*b* that can only be opened with a special designed key. The locking mechanism is comprised of the male portion of the locking mechanism 6*a* and the female portion 6*b*. The male portion of the locking mechanism 6*a* is a cylinder shaped pin that contains a key insert 4 and an opening containing three teeth 7 that latch on to the male insert 3 and its grooves 9. The male portion of the locking mechanism 6*a* slides and attaches itself through the female portion of the locking mechanism 6*b*, through the locking pin cavity 8 and cylinder pin apertures 5 contained in 10.

The band portion of the invention 2 (shown in FIGS. 3 and 4 for the flat band, and FIGS. 12 and 13 for the chain band) is comprised of a swivel hinge 10 containing two cylinder pin sized holes 5. The band portion 2 also contains a male connector 3 with three grooves 9 that insert into the locking mechanism 6*a* and 6*b*.

The swivel hinge 10 contains studs 13 which slide into the housing unit 1 through grooves 14 and is locked into place by the locking mechanism 6*a* and 6*b* after the male connector 3 slides through the female portion of the locking mechanism 6*b* and locks into place by the lock teeth 7 going through the locking grooves 9.

Both locking mechanisms create a safe and stable environment for the child and parent as the band and housing cannot be cut, or destroyed by fire, or water. This keeps the GPS device active and functioning which allows the parent to locate the missing child.

Figure 5:
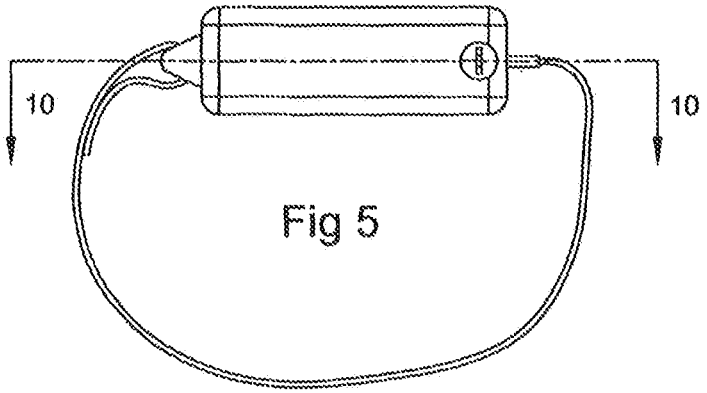
FIG. 5 is a side view of the flat band invention.
Figure 6:
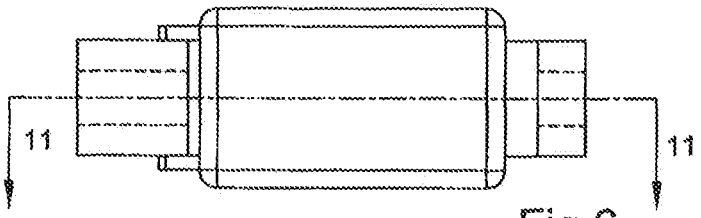
FIG. 6 is a top view of the flat band invention.
Figure 7:
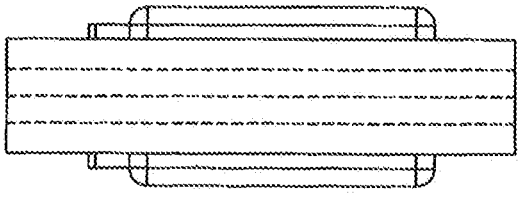
FIG. 7 is a bottom view of the flat band invention.
Figure 8:
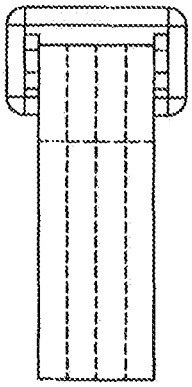
FIG. 8 is a perspective view of the front of the flat band invention.
Figure 9:
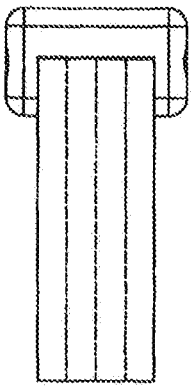
FIG. 9 is a perspective view of the back of the flat band invention.
Figure 12:
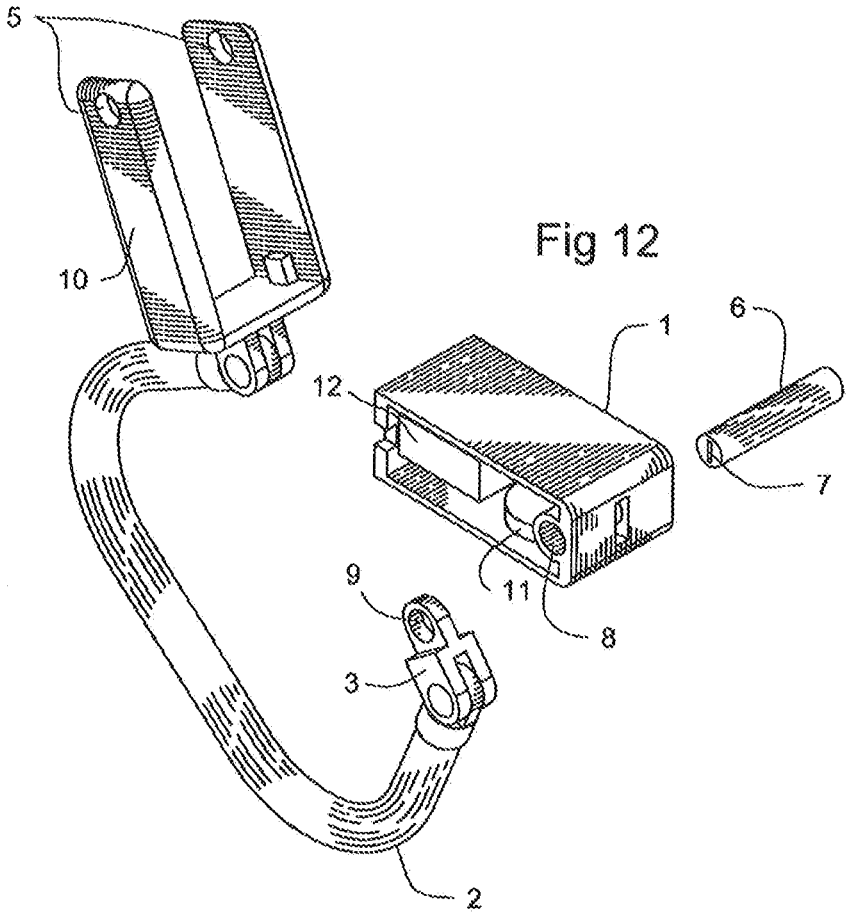
FIG. 12 is an exploded view of the bottom side of the locking mechanism of the chain type band invention.
Figure 13:
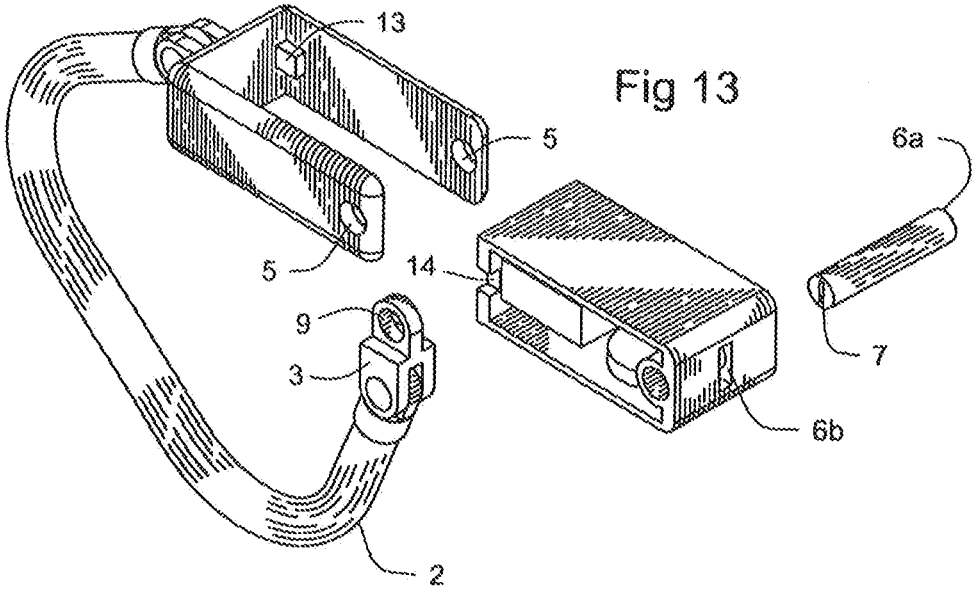
FIG. 13 is an exploded view of the top side of the locking mechanism of the chain type band invention.

FIGS. 5, 14 and 15 identify the size of the housing. FIGS. 7 and 8 identify the flat band 2 and FIGS. 16, 17 and 18 identify the chain band 2.

Figure 21:
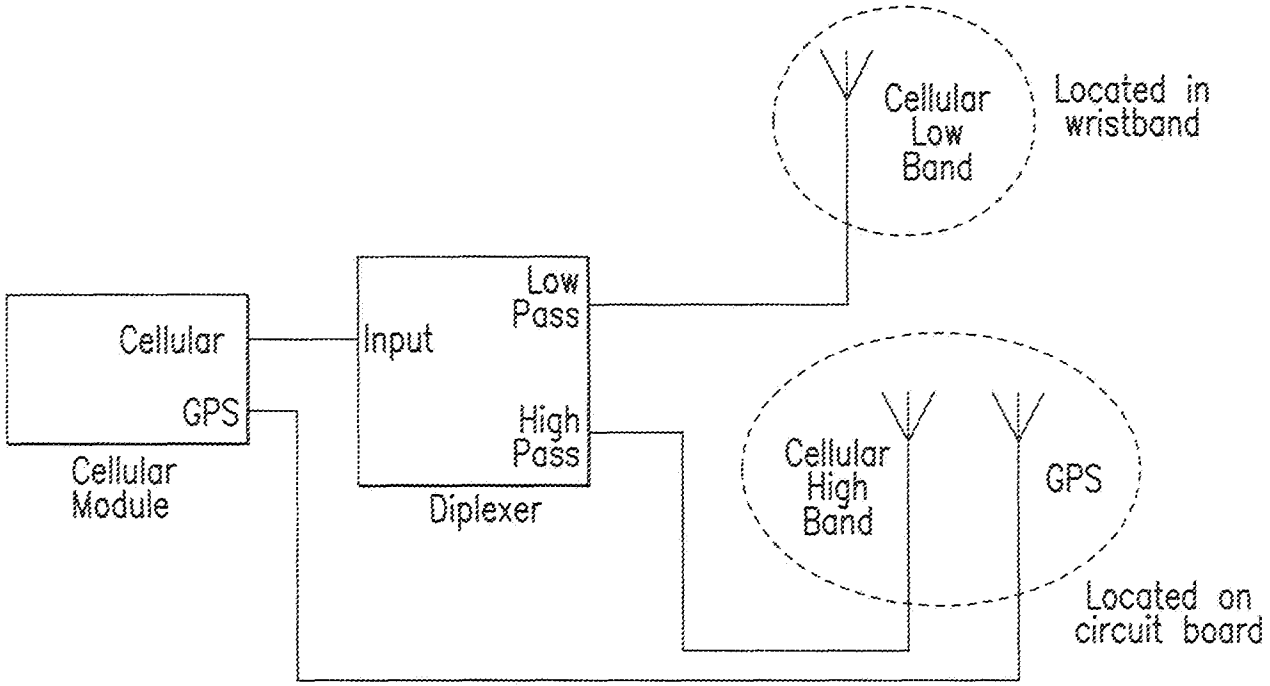
FIG. 21 is a schematic diagram of the high-band and low-band antennas configuration of the present invention.

FIG. 21 schematically depicts the high-band and low-band antenna configurations of the present invention, as described hereinabove.

Figure 22:
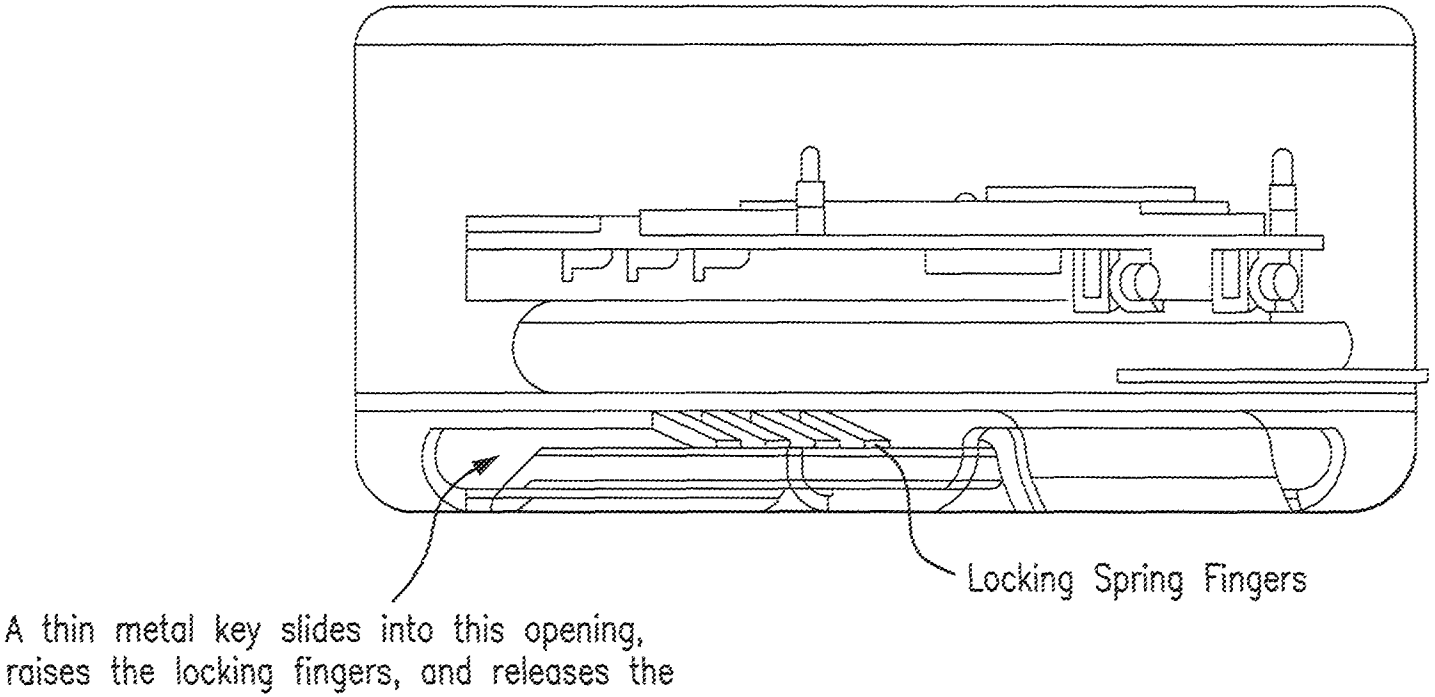
FIG. 22 is a side cross-section view of the custom mechanical locking mechanism of the present invention.

FIG. 22 depicts the custom mechanical locking mechanism of the present invention, as described hereinabove.

Figure 23A:
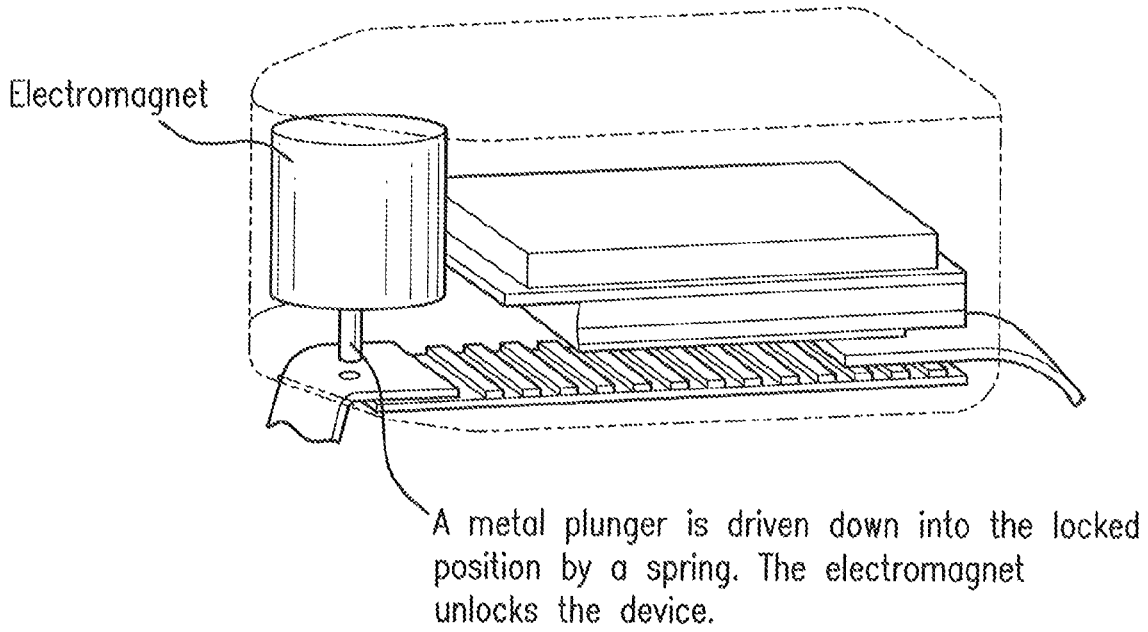
FIG. 23A is a perspective interior view of the electromagnetic locking mechanism of the present invention in the energized, unlocked configuration.
Figure 23B:
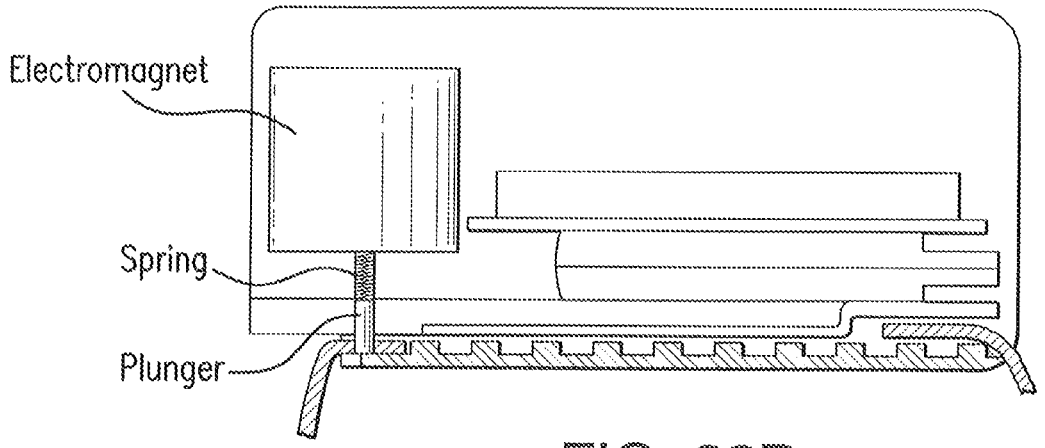
FIG. 23B is a side cross-section view of the electromagnetic locking mechanism of the present invention in the de-energized, locked configuration.

FIG. 23B depicts the electromagnetic locking mechanism of the present invention, as described hereinabove, in the de-energized, locked configuration.

FIG. 23A depicts the electromagnetic locking mechanism of the present invention, as described hereinabove, in the energized, unlocked configuration.

What is claimed is:

1. A locking GPS-based locator device, wearable by a child, comprising:

a housing unit, a connecting band, by which the housing unit is attachable to the child, and a locking mechanism, by which the connecting band is lockably attachable to the housing unit;

wherein the housing unit, having a proximal side and a distal side, defines a housing interior space, which contains a GPS module, a cellular module, one or more high-band antennas in electrical communication with the cellular module and the GPS module, a processing circuit, and a power source;

wherein the connecting band has a distal end, which is fixedly connected to the distal side of the housing unit, and a proximal end, which is lockably attachable to the proximal side of the housing unit;

wherein the connecting band contains one or more low-band antennas, which communicate electrically with the cellular module in the housing unit;

wherein the GPS module, upon activation, is configured to receive satellite GPS location data and to transmit the GPS location data to the processing circuit, which converts the GPS location data to one or more outgoing locator message signals, in text or audible format, which signals are sent by the cellular module, through one or more of the high-band or the low-band antennas, to one or more designated contacts; and wherein the processing circuit includes a diplex filter in electrical communication with the cellular module, and wherein the diplex filter separates the outgoing locator message signals into high-pass frequencies and low-pass frequencies, and wherein the diplex filter directs the high-pass frequencies to one or more of the high-band antennas in the housing unit, and wherein the diplex filter directs the low-pass frequencies to one or more of the low-band antennas in the connecting band.

2. The locator device of claim 1, wherein the GPS module is activated in a response mode, through the processing circuit, by the cellular module responding to a location request, in text or audible format, received through one or more of the high-band or the low-band antennas.

3. The locator device of claim 2, wherein the GPS module is activated in a periodic mode by the processing circuit at designated intervals.

4. The locator device of claim 3, wherein the locking mechanism comprises a mechanical locking mechanism, and wherein the mechanical locking mechanism comprises an array of locking springs in the proximal side of the housing unit, which locking springs conjugately engage a cooperating array of band apertures in the proximal end of the connecting band, thereby locking the proximal end of the connecting band to the proximal side of the housing unit, and wherein the locking mechanism further comprises a flat key having a horizontal pattern of key projections corresponding to positions of the locking springs, which key projections are configured so that the key projections, upon the key being inserted, without turning, into a key opening between the locking springs and the band apertures, lift the locking springs and cause the locking springs to disengage from the cooperating band apertures, thereby releasing the proximal end of the connecting band from the proximal side of the housing unit.

5. The locator device of claim 3, wherein the locking mechanism comprises an electromagnetic locking mechanism, comprising an electromagnet in electrical communication with the power source and a spring compressively connected to a ferromagnetic plunger pin, and wherein, when the electromagnet is electrically de-energized, the spring forces the plunger pin to extend through a pin opening in the proximal side of the housing unit and to engage conjugately a cooperating band opening in the proximal end of the connecting band, thereby locking the proximal end of the connecting band to the proximal side of the housing unit, and wherein, when the electromagnet is electrically energized, the electromagnet attracts the plunger pin so as to draw the plunger pin away from the band opening and to cause the plunger pin to disengage from the band opening, thereby releasing the proximal end of the connecting band from the proximal side of the housing unit.

6. The locator device of claim 5, wherein the processing circuit contains a Near Field Communication (NFC) component, and wherein the electromagnet is electrically energized in response to an NFC-transmitted unlocking code.

* * * * *